US007930897B2

(12) United States Patent
Eom et al.

(10) Patent No.: US 7,930,897 B2
(45) Date of Patent: Apr. 26, 2011

(54) WINDOW TYPE AIR CONDITIONER

(75) Inventors: Yoon-Seob Eom, Gyungsangnam-Do (KR); Jeong-Hwan Koo, Busan (KR); Nae-Hyun Park, Seoul (KR); Dong-Joo Han, Busan (KR); Byeong-Jo Ryoo, Gyungsangnam-Do (KR)

(73) Assignee: LG Electronics Inc., Seoul (KR)

( * ) Notice: Subject to any disclaimer, the term of this patent is extended or adjusted under 35 U.S.C. 154(b) by 1049 days.

(21) Appl. No.: 10/576,561

(22) PCT Filed: Sep. 16, 2004

(86) PCT No.: PCT/KR2004/002375

§ 371 (c)(1),
(2), (4) Date: Mar. 5, 2007

(87) PCT Pub. No.: WO2005/040686

PCT Pub. Date: May 6, 2005

(65) Prior Publication Data

US 2007/0256439 A1 Nov. 8, 2007

(30) Foreign Application Priority Data

Oct. 23, 2003 (KR) ..... 10-2003-0074382

(51) Int. Cl.
*F25D 23/12* (2006.01)

(52) U.S. Cl. ..... 62/262

(58) Field of Classification Search ..... 62/262, 62/285, 419, 426

See application file for complete search history.

(56) References Cited

U.S. PATENT DOCUMENTS

| | | | | |
|---|---|---|---|---|
| 2,309,224 | A | 1/1943 | Terry et al. | |
| 2,873,908 | A | 2/1959 | Powers | |
| 4,067,206 | A * | 1/1978 | Smith | 62/280 |
| 5,895,206 | A * | 4/1999 | Chuang et al. | 416/189 |
| 6,363,735 | B1 * | 4/2002 | Bushnell et al. | 62/280 |
| 6,511,287 | B2 * | 1/2003 | Kim | 415/204 |
| 6,948,908 | B2 * | 9/2005 | Jung et al. | 415/169.2 |
| 2003/0209024 | A1 * | 11/2003 | Lee | 62/262 |

FOREIGN PATENT DOCUMENTS

| | | |
|---|---|---|
| JP | 06-002888 | 1/1994 |
| JP | 2002-061599 | 2/2002 |

OTHER PUBLICATIONS

PCT Search Report dated Apr. 12, 2006.
PCT Written Opinion dated Apr. 12, 2006.

* cited by examiner

*Primary Examiner* — Melvin Jones
(74) *Attorney, Agent, or Firm* — Ked & Associates LLP

(57) ABSTRACT

A window type air conditioner comprises: a case of which one side is positioned indoors and another side is positioned outdoors; an axial fan mounted in the case for blowing the air in the radius direction thereof; a shroud having the axial fan therein and for guiding the air blown by the axial fan; and an orifice formed at the entrance of the shroud and covering the axial fan not to expose the axial fan to outside in order to prevent sucked air from colliding with the blade of the axial fan in the radius direction. According to this, the entire size of the air conditioner is minimized, noise is reduced, and the air volume passing through the outdoor heat exchanger is increased.

12 Claims, 8 Drawing Sheets

[Fig. 1]
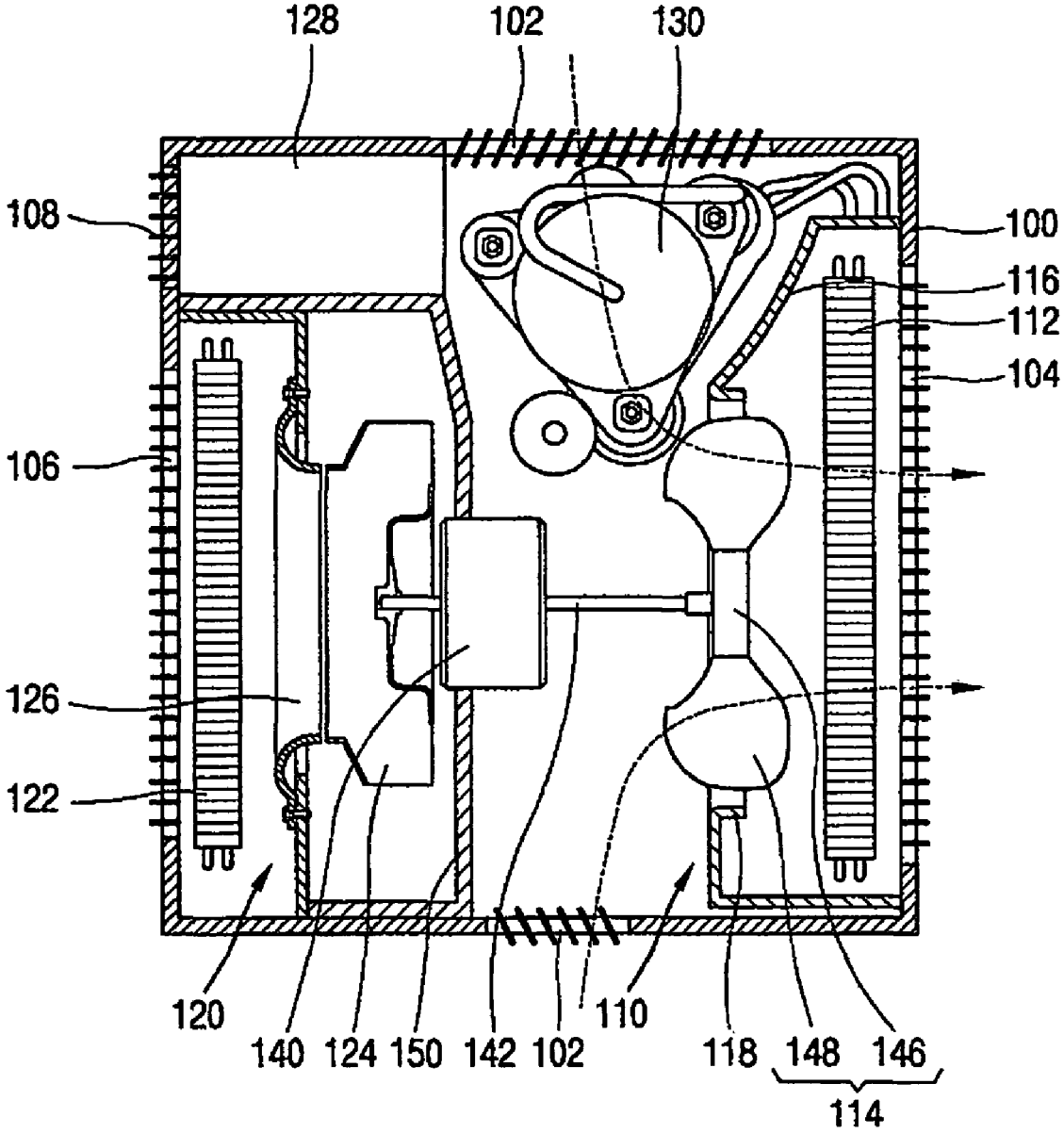

[Fig. 2]
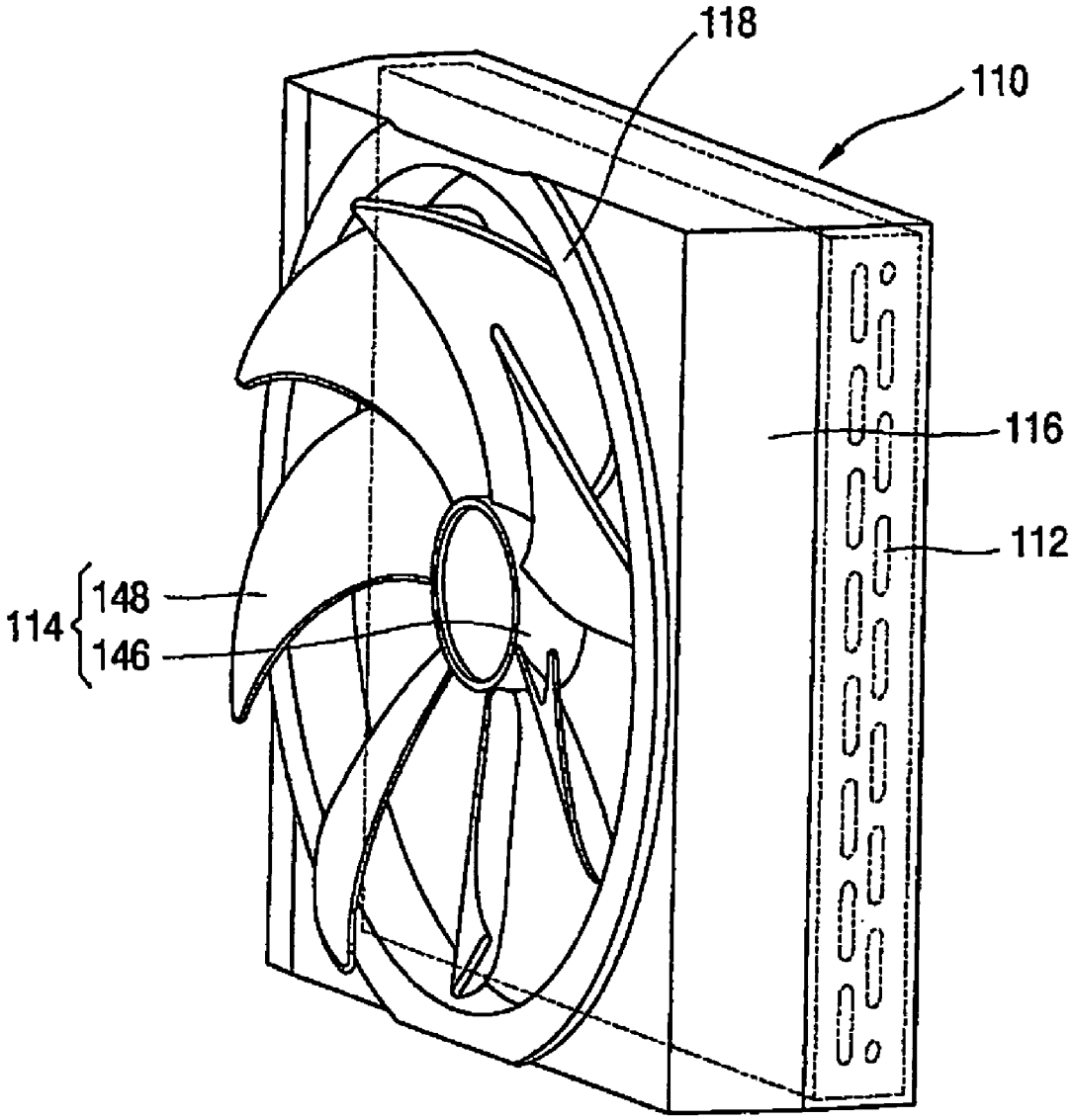

[Fig. 3]
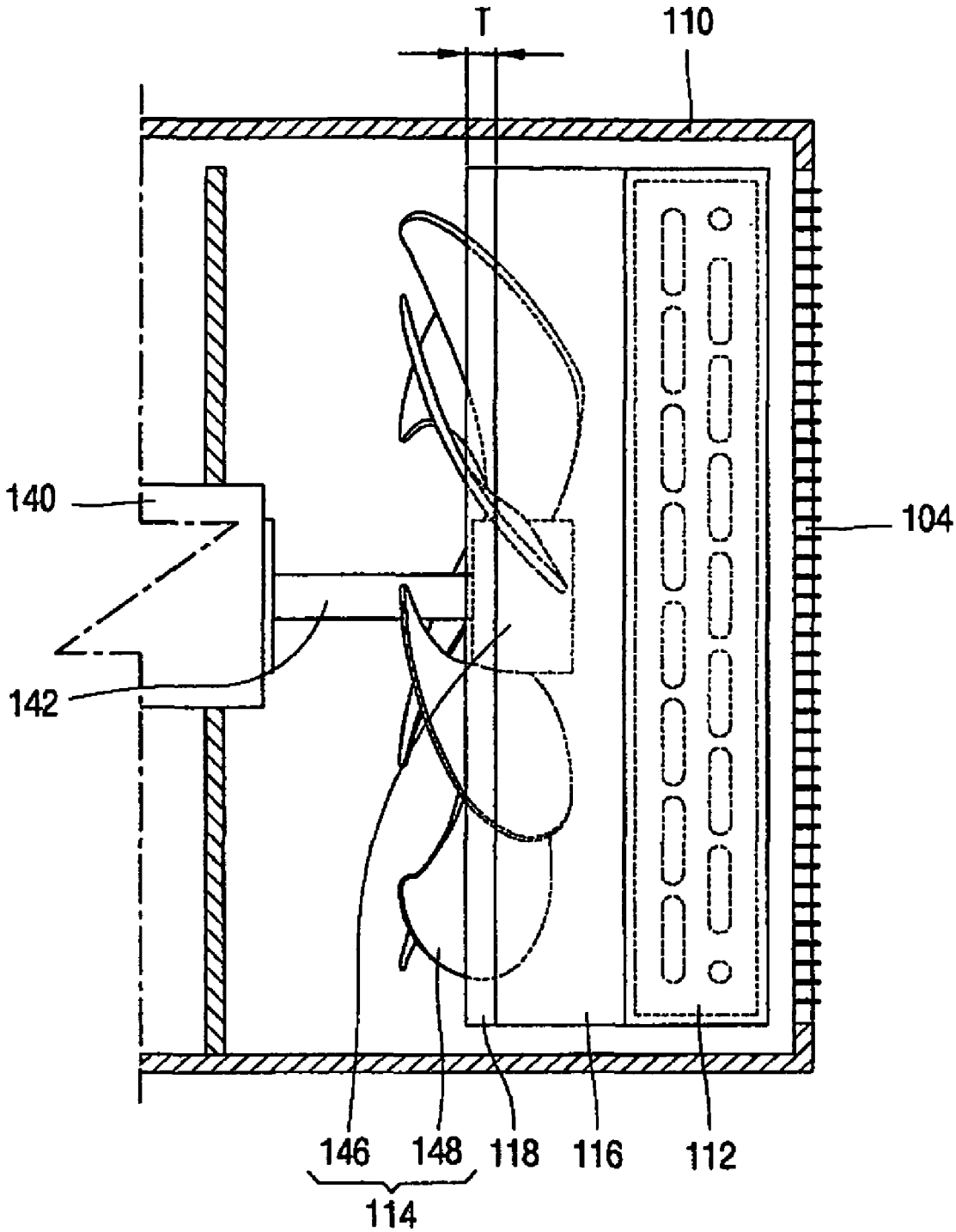

[Fig. 4]
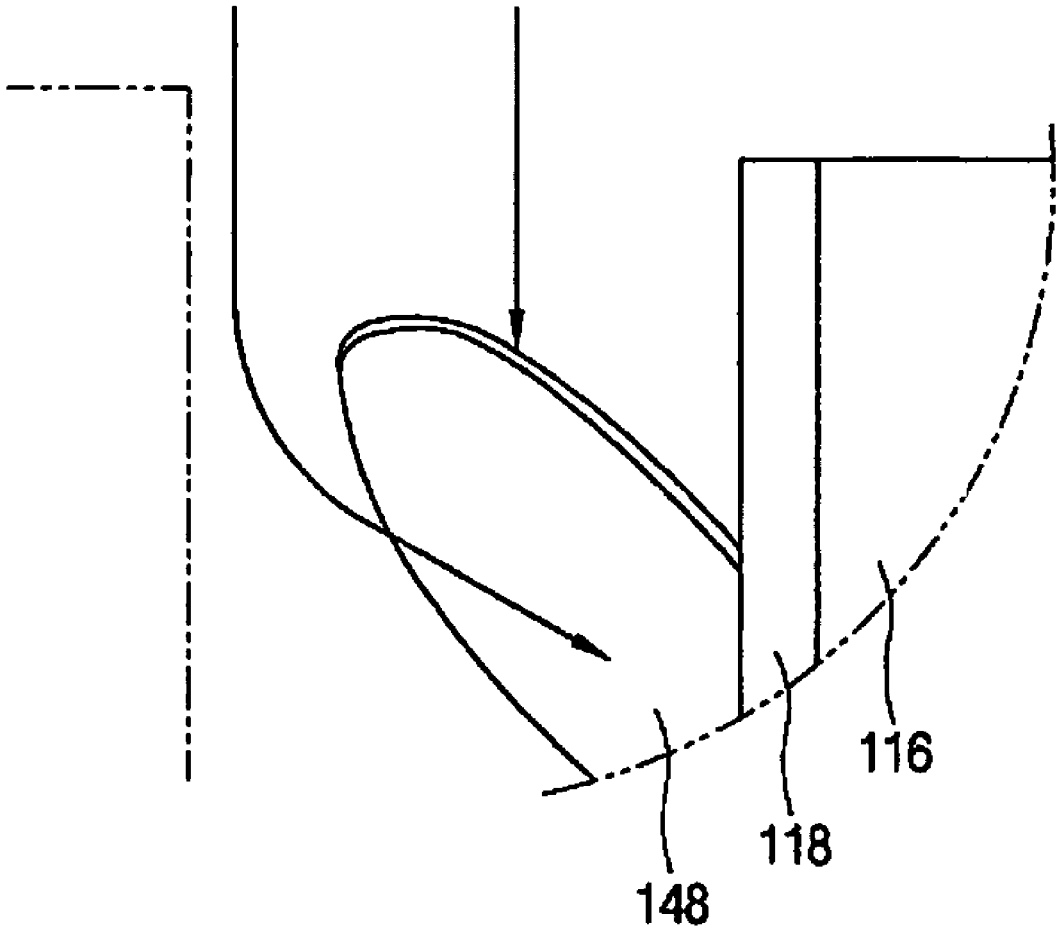

[Fig. 5]
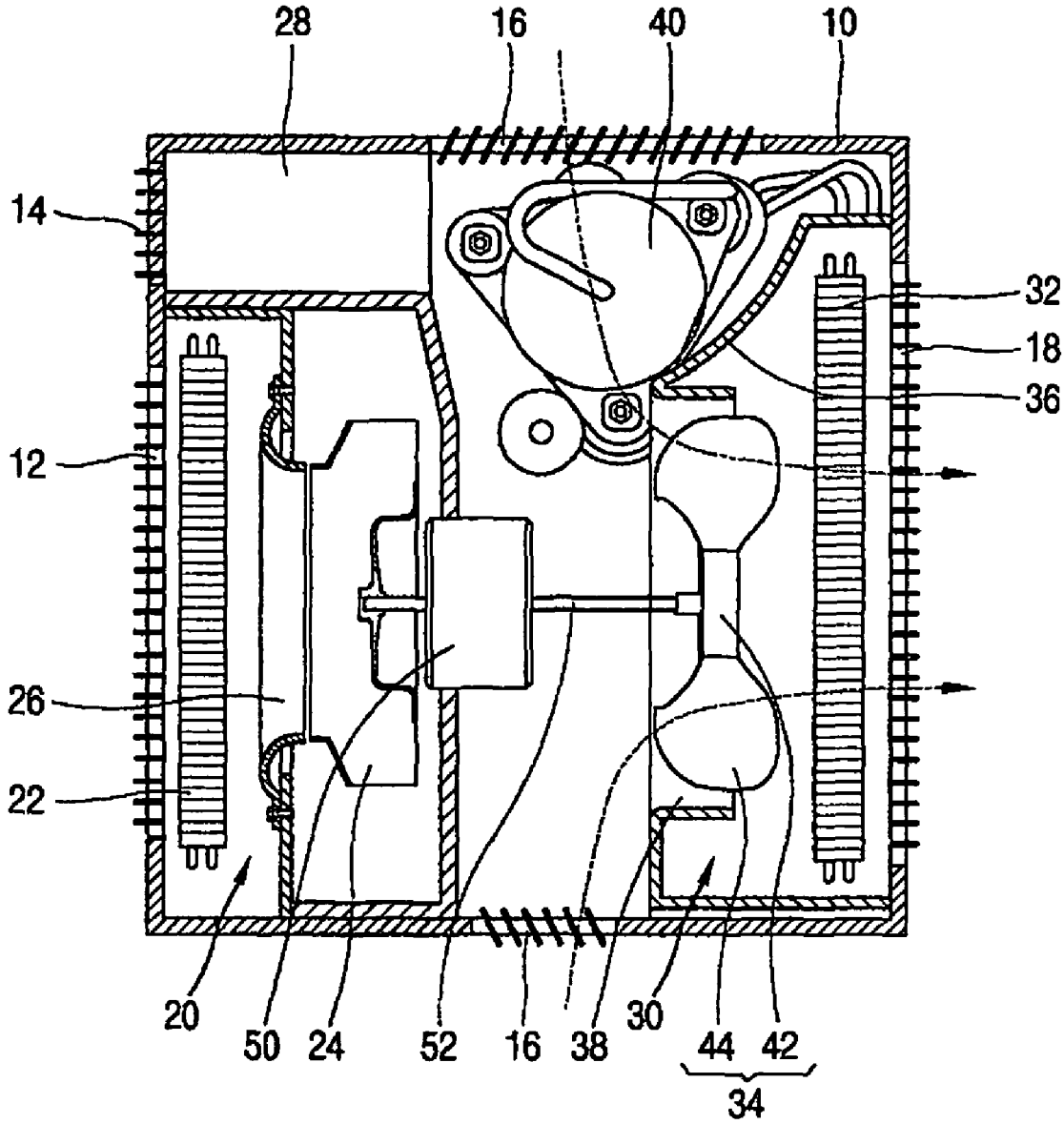

[Fig. 6]
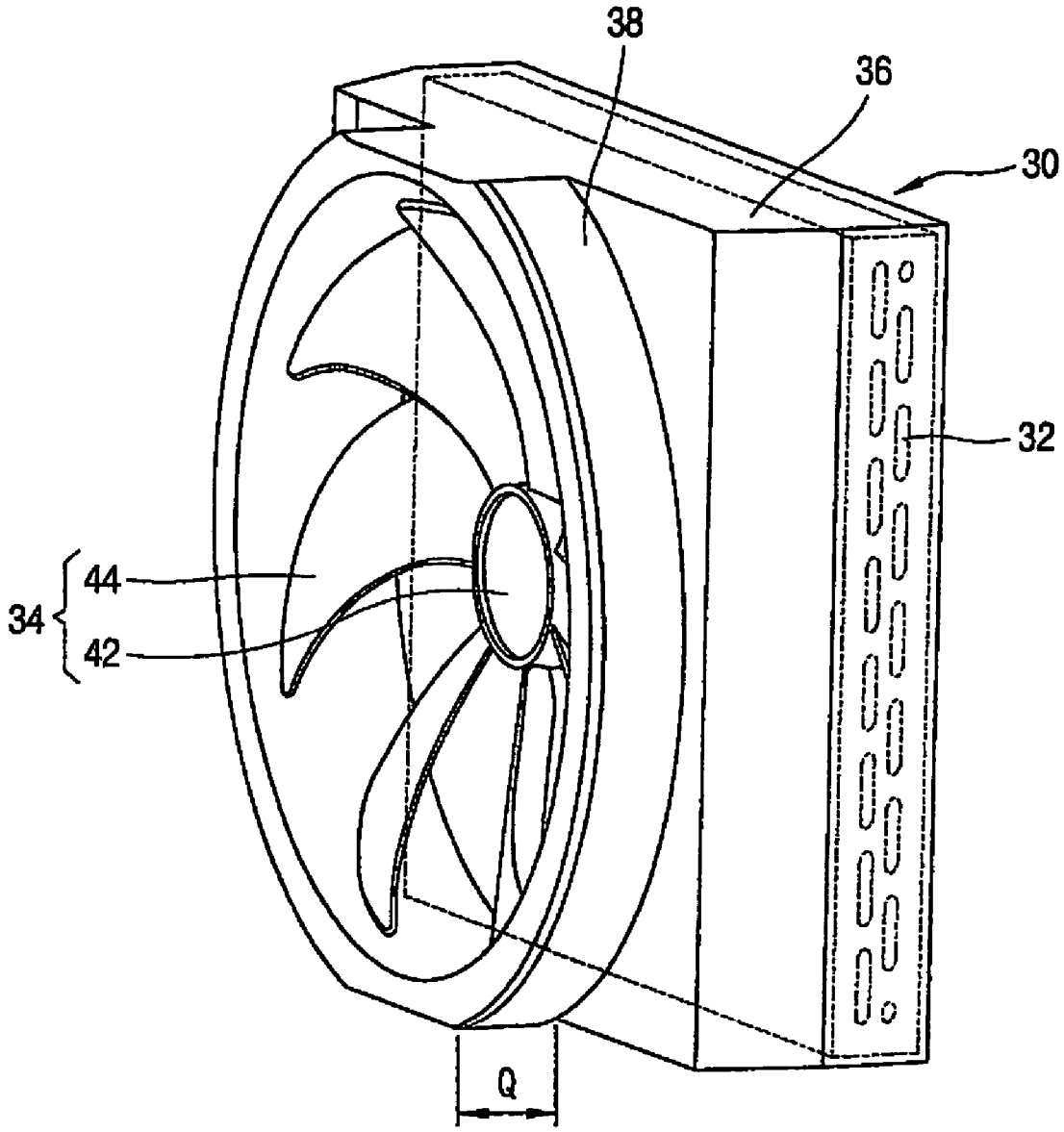

[Fig. 7]
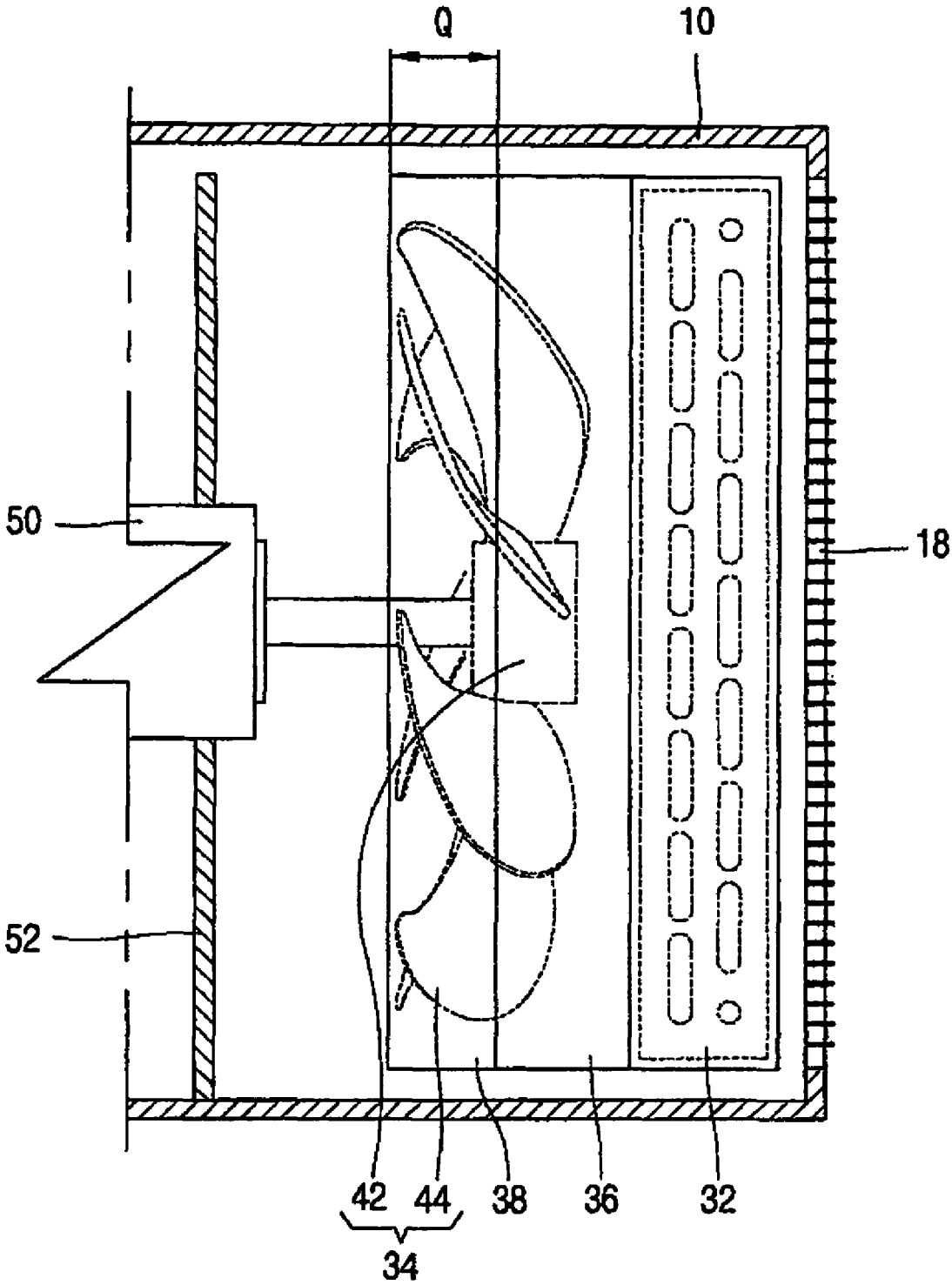

[Fig. 8]
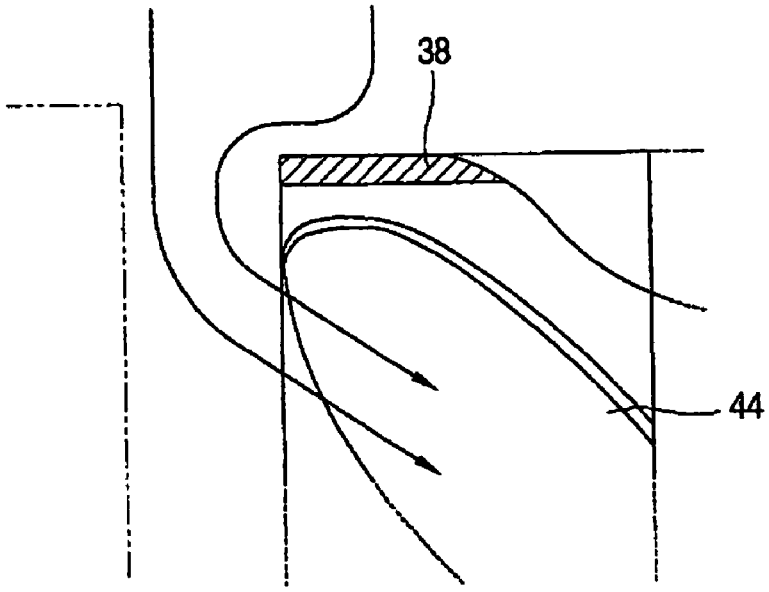
[Fig. 9]
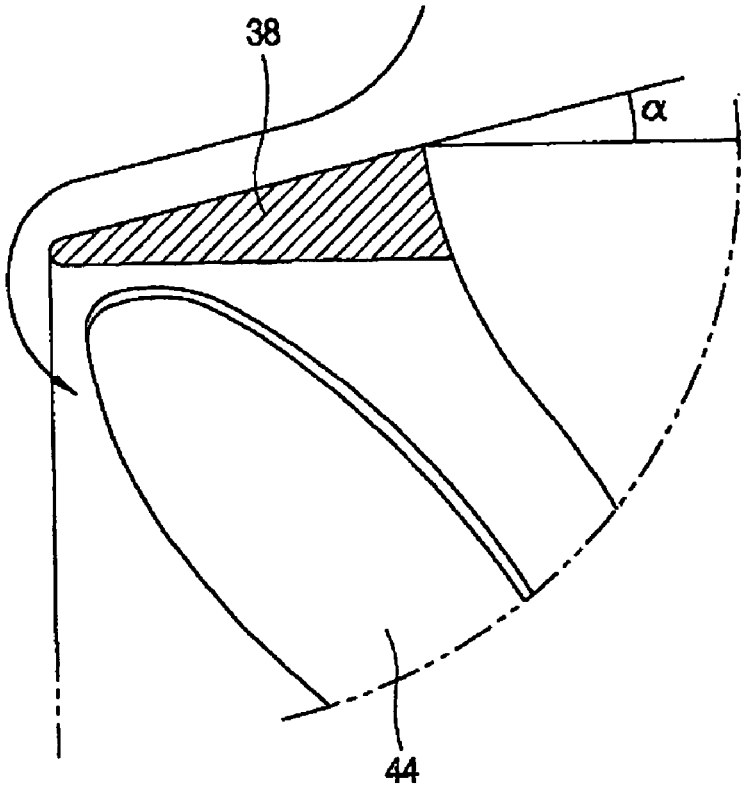

WINDOW TYPE AIR CONDITIONER

TECHNICAL FIELD

The present invention relates to a window type air conditioner, and more particularly, to a window type air conditioner capable of minimizing the entire size, reducing noise, and increasing the air volume.

BACKGROUND ART

In general, an air conditioner is provided with a refrigerating cycle constituted with a compressor, a condenser, a capillary tube, a heat exchanger, etc., and properly supplies cool air generated from an evaporator and warm air generated from the condenser indoors according to the indoor condition, thereby maintaining the indoor circumstance comfortably.

The air conditioner is divided into a window type air conditioner and a separated type air conditioner according to an installation method. The window type air conditioner is installed at the window, etc. under the state that an outdoor unit and an indoor unit are integrally assembled in one case, and the separate type air conditioner is respectively installed at the outdoor and the indoor under the state that the outdoor unit and the indoor unit are separated from each other.

FIG. 1 is a sectional view showing a window type air conditioner in accordance with the conventional art, and FIG. 2 is a perspective view showing an outdoor unit of the window type air conditioner in accordance with the conventional art.

The conventional window type air conditioner comprises: a case 100 of which one side is positioned at the outdoor side and another side is positioned at the indoor side; an outdoor unit 110 installed at the outdoor side of the case 100 and heat-exchanged with the outdoor air; an indoor unit 120 installed at the indoor side of the case 100 and heat-exchanged with the indoor air; and a compressor 130 for compressing a refrigerant.

The case 100 is installed at the wall that divides the outdoors and the indoors, and one side of the case 100 is positioned at the outdoor side and another side thereof is positioned at the indoor side on the basis of the wall. An outdoor air suction port 102 for sucking the outdoor air is formed at both lateral surfaces of the case 100 positioned at the outdoor side. Also, an outdoor air discharge port 104 for discharging the air that has been heat-exchanged while passing through the outdoor unit 110 outdoors is formed at the rear surface of the case 100. At the front surface of the case 100 positioned at the indoor side, an indoor air suction port 106 for sucking the indoor air and an indoor air discharge port 108 for discharging the air that has been heat-exchanged while passing through the indoor unit 120 indoors are respectively formed.

The outdoor unit 110 is composed of: an outdoor heat exchanger 112 installed inside the case 100 positioned at the outdoor side and connected to the compressor 130 by a refrigerant pipe thus to be heat-exchanged with the outdoor air; and an axial fan 114 opposite to the outdoor heat exchanger 112 for generating a blowing force to suck the outdoor air and thus to discharge it to the outdoor heat exchanger 112.

The axial fan 114 is mounted in a shroud 116 for guiding the outdoor air sucked by the axial fan 114 to the outdoor heat exchanger 112. The shroud 116 is provided with an orifice 118 for attenuating a velocity vector in a radius direction of the outdoor air at the time of sucking the outdoor air.

The shroud 116 is provided with the orifice 118 at one side surface thereof, and is provided with the outdoor heat exchanger 112 at another side surface thereof. The shroud 116 is formed as a hexahedron shape that the axial fan 114 is rotatably mounted therein.

As shown in FIG. 3, the orifice 118 is formed as a circular ring shape wound on the outer circumferential surface of the axial fan 114, and is integrally formed at the shroud 116. The orifice 118 has the width T enough wide for the axial fan 114 to be partially exposed to outside of the orifice 118.

The axial fan 114 is composed of: a hub 146 connected to a driving motor 140 by a rotational shaft 142; blades 148 formed at the outer side of the hub 146 in a circumferential direction with the same interval. One side of the blade 148 is mounted in the shroud 116, and another side thereof is exposed to outside of the orifice 118.

The indoor unit 120 is composed of: an indoor heat exchanger 122 installed inside the case 100 positioned at the indoor side for heat-exchanging the indoor air; and a centrifugal fan 124 opposite to the indoor heat exchanger 122 for generating a blowing force so that the indoor air can pass through the indoor heat exchanger 122.

An orifice 126 for guiding the indoor air that has passed through the indoor heat exchanger 122 to the centrifugal fan 124 is formed between the indoor heat exchanger 122 and the centrifugal fan 124. An air guide 128 for guiding the air that has passed through the centrifugal fan 124 to the indoor air discharge port 108 is installed at the upper side of the centrifugal fan 124.

A division plate 150 for dividing the outdoor unit 110 and the indoor unit 120 is installed inside the case 100, and a driving motor 140 for driving the centrifugal fan 124 and the axial fan 114 is mounted at the division plate 150.

Operation of the window type air conditioner in accordance with the conventional art will be explained in more detail. When a power source is applied to the air conditioner, the compressor 130 and the driving motor 140 are driven thus to heat-exchange the outdoor air at the outdoor unit 110 and to heat-exchange the indoor air at the indoor unit 120.

More specifically, when the axial fan 114 is driven, the outdoor air is sucked into the case 100 through the outdoor air suction port 102 formed at both lateral surfaces of the case 100. The outdoor air sucked into the case 100 is sucked into the shroud 116 through the orifice 118 thus to condense the refrigerant while passing through the outdoor heat exchanger 112. Then, the outdoor air is discharged outdoors through the outdoor air discharge port 104.

When the centrifugal fan 124 is driven, the indoor air is sucked through the indoor air suction port 106 thus to be cooled while passing through the indoor heat exchanger 122. Then, the indoor air is discharged indoors through the indoor air discharge port 108.

However, in the conventional window type air conditioner, the outdoor air suction port 102 is formed at both lateral surfaces of the case 100, and the axial fan 114 is installed to be exposed to outside of the orifice 118. According to this, as shown in FIG. 4, the outdoor air sucked in the radius direction of the axial fan 114 collides with the rear surface of the blade 148 of the axial fan 114 thus to generate noise. The air that has collided with the blade 148 backflows by a centrifugal force thus to cause a flow loss. According to this, the air volume passing through the outdoor heat exchanger 112 is reduced thereby to lower the function of the outdoor heat exchanger 112.

To solve said problem, the inner area of the case 100 to which the outdoor air is sucked has to be wide. However, in the case, the entire size of the window type air conditioner is increased.

DISCLOSURE

Therefore, it is an object of the present invention to provide a window type air conditioner capable of minimizing the entire size thereof, reducing noise, and increasing the air volume passing through an outdoor heat exchanger by smoothly sucking the outdoor air by improving the structure of an orifice.

To achieve these objects, there is provided a window type air conditioner comprising: a case of which one side is positioned indoors and another side is positioned outdoors; an axial fan mounted in the case for blowing the air in the radius direction thereof; a shroud having the axial fan therein and for guiding the air blown by the axial fan; and an orifice formed at the entrance of the shroud and covering the axial fan not to expose the axial fan to outside in order to prevent sucked air from colliding with the blade of the axial fan in the radius direction.

The orifice is formed as a circular ring shape, and has a certain width to prevent the axial fan from being exposed to the outside.

The outer diameter of the orifice is formed as an inclination surface that is increased towards a part connected to the shroud.

DESCRIPTION OF DRAWINGS

FIG. 1 is a sectional view showing a window type air conditioner in accordance with the conventional art;

FIG. 2 is a perspective view showing an outdoor unit of the window type air conditioner in accordance with the conventional art;

FIG. 3 is a sectional view showing the outdoor unit of the window type air conditioner in accordance with the conventional art;

FIG. 4 is a partial lateral view showing the outdoor unit of the window type air conditioner in accordance with the conventional art;

FIG. 5 is a sectional view showing a window type air conditioner according to one embodiment of the present invention;

FIG. 6 is a perspective view of an outdoor unit of the window type air conditioner according to one embodiment of the present invention;

FIG. 7 is a sectional view showing the outdoor unit of the window type air conditioner according to one embodiment of the present invention;

FIG. 8 is a partial lateral view of the outdoor unit of the window type air conditioner according to one embodiment of the present invention; and FIG. 9 is a partial lateral view of the outdoor unit of the window type air conditioner according to another embodiment of the present invention.

BEST MODE

Hereinafter, preferred embodiments of a window type air conditioner will be explained as follows.

Even if a plurality of preferred embodiments can exist in the present invention, the most preferred embodiment will be explained.

FIG. 5 is a sectional view showing a window type air conditioner according to one embodiment of the present invention, and FIG. 6 is a perspective view of an outdoor unit of the window type air conditioner according to one embodiment of the present invention.

The window type air conditioner according to one embodiment of the present invention comprises: a case 10 arranged at the wall that divides the outdoors and the indoors and having one side positioned at the outdoor side and another side positioned at the indoor side; an indoor unit 20 installed at the indoor side of the case 10 and heat-exchanged with the indoor air; an outdoor unit 30 installed at the outdoor side of the case 10 and heat-exchanged with the outdoor air; and a compressor 40 for compressing a refrigerant into a gas refrigerant of a high temperature and a high pressure.

An indoor air suction port 12 for sucking the indoor air and an indoor air discharge port 14 for discharging the air that has been heat-exchanged while passing through the indoor unit 20 to the indoor side are separately formed up and down at the front surface of the case 10 positioned at the indoor side.

Also, an outdoor air suction port 16 for sucking the outdoor air is formed at both lateral surfaces of the case 10 positioned at the outdoor side, and an outdoor air discharge port 18 for discharging the air that has passed through the outdoor unit 30 to the outdoor side is formed at the rear surface of the case 10 positioned at the outdoor side.

The indoor unit 20 is composed of: an indoor heat exchanger 22 for passing the indoor air and thereby cooling; and an indoor centrifugal fan 24 formed inside the indoor heat exchanger 22 and connected to a driving motor 50, for generating a blowing force so that the indoor air sucked into the indoor air suction port 12 can pass through the indoor heat exchanger 22.

An orifice 26 for guiding the indoor air that has passed through the indoor heat exchanger 22 to the indoor centrifugal fan 24 is formed between the indoor centrifugal fan 24 and the indoor heat exchanger 22. An air guide 28 for guiding the air that has passed through the indoor centrifugal fan 24 to the indoor air discharge port 14 is formed at the upper side of the indoor centrifugal fan 24.

As shown in FIGS. 6 and 7, the outdoor unit 30 is composed of: an outdoor heat exchanger 32 for heat-exchanging the outdoor air sucked through the outdoor air suction port 16 positioned at the outdoor side; and an outdoor axial fan 34 for generating a blowing force so that the outdoor air can be sucked and thereby can pass through the outdoor heat exchanger 32.

The outdoor axial fan 34 is composed of: a hub 42 connected to the driving motor 50 by a rotational shaft 52; and blades 44 formed at the outer circumferential surface of the hub 42 with the same interval for generating a blowing force. The outdoor axial fan 34 is mounted in a shroud 36 that is mounted in the case 10 positioned at the outdoor side. Also, an orifice 38 for attenuating a velocity vector of the outdoor air in the radius direction at the time of sucking the outdoor air is formed at the shroud 36.

The orifice 38 is formed at one side of the shroud 36, and the outdoor heat exchanger 32 is mounted at another side of the shroud 36. The outdoor axial fan 34 is rotatably installed in the shroud 36 thus to guide the outdoor air sucked by the outdoor axial fan 34 to the outdoor heat exchanger 32.

The orifice 38 is formed at the entrance of the shroud 36 and covers the outer circumferential surface of the axial fan 34 not to expose the axial fan 34 to outside in order to prevent sucked air from colliding with the blade 44 of the axial fan 34 in the radius direction.

That is, the orifice 38 is integrally formed at the shroud 36 as a circular ring shape, and has a certain width Q towards the front side of the shroud 36 so as to completely cover the blade 44 of the axial fan 34.

As shown in FIG. 8, the outer diameter and inner diameter of the orifice 38 between the part connected to the shroud 36 and the end portion of the outermost side are same.

As another embodiment of the orifice 38, as shown in FIG. 9, the outer diameter of the orifice 38 can be formed as an inclination surface of a certain angle α that is increased towards the part connected to the shroud 36 from the end portion of the outermost side. Herein, the inner diameter of the end portion of the outermost side of the orifice 38 is equal to the inner diameter of the part connected to the shroud 36.

Operation of the window type air conditioner will be explained as follows.

When a power source is applied to the air conditioner, the compressor 40 is driven thus to cool the refrigerant, the indoor centrifugal fan 24 is driven thus to heat-exchange the indoor air by the indoor heat exchanger 22, and the outdoor axial fan 34 is driven thus to heat-exchange the outdoor air by the outdoor heat exchanger 32.

At this time, the indoor unit 20 is operated as follows. When the indoor centrifugal fan 24 is driven as the power source is applied to the driving motor 50, the indoor air is sucked into the case 10 through the indoor air suction port 12 formed at the front side of the case 10 thus to be cooled while passing through the indoor heat exchanger 22. The cooled air is glided by the air guide 28 thus to be discharged to the indoors through the indoor air discharge port 14 formed at the upper side of the front side of the case 10.

Also, the outdoor unit 30 is operated as follows. When the outdoor axial fan 34 is driven as the power source is applied to the driving motor 50, the outdoor air is sucked into the case 10 through the outdoor air suction port 16 formed at both lateral surfaces of the case 10. The outdoor air sucked into the case is introduced into the shroud through the orifice thus to be heat-exchanged while passing through the outdoor heat exchanger 32. Then, the heat-exchanged air is discharged to the outdoors through the outdoor air discharge port 18 formed at the rear side of the case 10.

Herein, since the orifice 38 covers the outdoor axial fan 34 not to expose it to outside, the outdoor air sucked in the radius direction through the outdoor air suction port 16 does not collide with the blade 44 of the outdoor axial fan 34 in the lateral direction but flows along the outer circumferential surface of the orifice 38 thus to be introduced to the outdoor axial fan 34 in the lateral direction.

According to this, the phenomenon that the outdoor air collides with the blade 44 of the outdoor axial fan 34 in the lateral direction is prevented thus to reduce noise. Also, the phenomenon that the outdoor air backflows by a centrifugal force generated when the outdoor air collides with the blade 44 of the axial fan 34 in the lateral direction is prevented thus to increase a flow amount of the air.

As shown in FIG. 9, the inclination surface is formed at the outer circumferential surface of the orifice 38 so that the outdoor air may flow more smoothly along the outer circumferential surface of the orifice 38, thereby increasing a suction amount of the air.

In the window type air conditioner according to the present invention, the orifice is formed with a certain with towards the front side of the shroud thereby to completely cover the outdoor axial fan. According to this, the outdoor air sucked through the outdoor air suction port in the radius direction is prevented from colliding with the blade of the outdoor axial fan thus to reduce noise. Also, since the air flows smoothly, the air volume passing the outdoor heat exchanger is increased thus to increase the function of the outdoor heat exchanger.

Additionally, since the outdoor air smoothly flows along the outer circumferential surface of the orifice, the inner space of the case to which the outdoor air is sucked is decreased thus to minimize the entire size of the air conditioner.

It will be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A window type air conditioner, comprising:
- a case, one side of which is positioned indoors and another side of which is positioned outdoors;
- an axial fan mounted in the case that blows air in an axial direction thereof;
- a shroud having the axial fan therein, wherein the shroud guides the air blown by the axial fan; and
- an orifice provided at an entrance of the shroud, the orifice surrounding and covering the axial fan in such a manner as to prevent sucked air from colliding with blades of the axial fan in a radius direction.

2. The window type air conditioner of claim 1, wherein the orifice is formed in the shape of a circular ring and has a certain width so that the orifice prevents the axial fan from being exposed to outside.

3. The window type air conditioner of claim 1, wherein an outer diameter of the orifice at a part connected to the shroud and an outer diameter of the orifice at an opened end portion are the same.

4. The window type air conditioner of claim 1, wherein an outer diameter of the orifice is formed as an inclined surface such that the outer diameter of the orifice increases towards the part connected to the shroud.

5. The window type air conditioner of claim 1, wherein an inner diameter of the orifice at the entrance of the shroud is equal to an inner diameter at an opened end portion.

6. A window type air conditioner, comprising:
- a case, one side of which is positioned indoors and another side of which is positioned outdoors;
- an indoor device mounted in the case positioned at the indoor side that heat-exchanges indoor air; and
- an outdoor device mounted in the case positioned at the outdoor side that heat-exchanges outdoor air, wherein the outdoor device includes:
  - an outdoor heat exchanger that heat-exchanges sucked outdoor air;
  - an outdoor axial fan that generates a blowing force so that the outdoor air is sucked and thereby passes through the outdoor heat exchanger;
  - a shroud having the axial fan therein, wherein the shroud guides the air blown by the axial fan; and
  - an orifice provided at an entrance of the shroud, the orifice surrounding and covering the axial fan in such a manner as to prevent sucked air from colliding with blades of the axial fan in a radius direction.

7. The window type air conditioner of claim 6, wherein the orifice is formed in the shape of a circular ring and has a certain width so that the orifice prevents the axial fan from being exposed to outside.

8. The window type air conditioner of claim 6, wherein an outer diameter of the orifice at a part connected to the shroud and an outer diameter of the orifice at the opened end portion are the same.

9. The window type air conditioner of claim 6, wherein an outer diameter of the orifice is formed as an inclined surface such that the outer diameter of the orifice increases towards the part connected to the shroud.

10. The window type air conditioner of claim 6, wherein an inner diameter of the orifice at the entrance of the shroud is equal to an inner diameter at an opened end portion.

11. The window type air conditioner of claim 1, wherein the orifice surrounds and covers a lateral portion of the axial fan to prevent sucked air from colliding with blades of the axial fan in a radius direction.

12. The window type air conditioner of claim 6, wherein the orifice surrounds and covers a lateral portion of the axial fan to prevent sucked air from colliding with blades of the axial fan in a radius direction.

* * * * *